United States Patent [19]

Fleming

[11] Patent Number: 4,864,184

[45] Date of Patent: Sep. 5, 1989

[54] LAMP CONSTRUCTION AND METHOD OF MANUFACTURE

[75] Inventor: Raymond T. Fleming, Lexington, Ky.

[73] Assignee: GTE Products Corporation, Danvers, Mass.

[21] Appl. No.: 123,674

[22] Filed: Nov. 23, 1987

[51] Int. Cl.[4] ..... H01J 5/58

[52] U.S. Cl. ..... 313/318; 313/331; 313/623; 445/29; 445/32; 439/611

[58] Field of Search ..... 313/318, 623, 331, 49, 313/51; 439/611, 619; 445/29, 32

[56] References Cited

U.S. PATENT DOCUMENTS

| | | | |
|---|---|---|---|
| 3,314,331 | 4/1967 | Wiley | 313/318 |
| 3,469,140 | 9/1969 | Bottone et al. | 313/318 |
| 4,084,112 | 4/1978 | Hebert et al. | 313/318 X |
| 4,243,907 | 1/1981 | Kohl et al. | 313/318 |
| 4,499,404 | 2/1985 | Walsh | 313/318 |

*Primary Examiner*—Donald J. Yusko
*Assistant Examiner*—Michael Horabik
*Attorney, Agent, or Firm*—Edward J. Coleman; William E. Meyer

[57] ABSTRACT

An improved lamp construction and associated method of manufacture of a lamp that includes a sealed capsule with lead-in wires and a ceramic base. A pair of sleeves each defining a lamp contact pin at one end thereof are swaged at the other end thereof to the lead-in wires to secure the sleeves thereto. The ceramic base has a bottom wall with a pair of holes therein for receiving respective sleeves with the contact pin ends thereof depending from the base bottom wall and with the swaged ends thereof defining a limiting wall for positioning of the sleeves in proper relation relative to the ceramic base. The cement is disposed in the ceramic base and cured to secure the sleeves and lead-in wires in the ceramic base.

17 Claims, 3 Drawing Sheets

LAMP CONSTRUCTION AND METHOD OF MANUFACTURE

TECHNICAL FIELD

The present invention relates in general to an improved lamp construction in which the lamp capsule has a press-sealed end. The present invention relates both to an improved lamp construction as well as an improved method of manufacture of the lamp. The present invention is, in particular, employed in connection with a miniature two pin tungsten halogen lamp.

BACKGROUND

An incandescent lamp, and in particular a tungsten halogen lamp is generally comprised of a lamp capsule in the form of a sealed envelop of vitreous material having a bulb portion and a press-sealed portion, and a lamp base which is typically a ceramic base for holding the lamp capsule. Lamps of this very general type are shown in the following U.S. Pat. Nos.: 3,431,540; 4,145,631; 4,243,907; 4,499,404; and 4,568,854. In these lamp constructions, the lamp capsule typically has associated therewith a pair of electrically conductive lead-in wires that are hermetically sealed through the press-sealed portion in spaced-apart relationship to one another and extending beyond the press-sealed portion with the lead-in wires connected to a filament structure positioned within the bulb portion. The conductive lead-in wires are typically molybdenum wires.

In the existing lamp construction, the lamp capsule is assembled in the ceramic base in the following manner. The molybdenum leads are sand blasted and then trimmed to the correct length. Lead wires are welded to the molybdenum leads of the capsule. Contact pins are staked into the ceramic base forming a ceramic base subassembly. The lead wires welded to the molybdenum leads are dipped into a solder flux and inserted into the contact pins supported in the ceramic base. The lead wires are inserted into the pins to a proper depth with the use of a fixture to set the approximate light center position. The lead wires are soldered to the contact pins by dipping into a lead-zinc solder (95:5 ratio) and excess wire is trimmed flush with the end of the contact pin. The lamp light center is set on a comparator by positioning the filament in a box by hand. The base is then filled with cement and the lamp is inserted into an oven to cure the cement.

There are several drawbacks and disadvantages associated with this prior art method of assembly. The weld between the lead wires and the molybdenum leads may become broken when setting the light center position. The step of welding the lead wires to the molybdenum leads is generally somewhat difficult to carry out. The lead wires must be welded parallel to the molybdenum leads. There is generally a poor appearance of the finished assembly due to the lead wires being welded to one side of the molybdenum leads extending from the lamp capsule. Errors may also develop, requiring reworking of lamp assembly due to an improper positioning of the light center height during the soldering operation. Also, it is generally a relatively difficult procedure to stake the pins in the ceramic base in a secure manner.

DISCLOSURE OF THE INVENTION

Accordingly, it is one object of the present invention to provide an improved lamp construction and associated method of manufacture which in particular eliminates several of the steps in construction of the lamp in comparison to present prior art techniques.

Another object of the present invention is to provide an improved lamp construction in which there is substantially less requirement for reworking during lamp assembly due to weld breakage.

A further object of the present invention is to provide an improved lamp construction and associated method of manufacture which eliminates the procedure of staking pins in the base, eliminates the lead wire weld to the capsule lead-in wires, eliminates the sandblasting of the lamp capsule lead-in wires, and furthermore eliminates the previously necessary soldering operation.

Still another object of the present invention is to provide an improved lamp construction and associated method of manufacture in which the total number of parts used in constructing the lamp is reduced, the associated number of steps in assembly is reduced, and furthermore in which the finished lamp has an improved overall lamp appearance.

In accordance with one aspect of the present invention, there is provided an improved lamp construction and, in particular, an improved construction for an incandescent lamp such as a tungsten halogen lamp. The lamp is comprised of a sealed envelope of vitreous material having a bulb portion and a press-sealed portion at one end thereof. A pair of electrically conductive lead-in wires are hermetically sealed through the press-sealed portion and are disposed in spaced apart relationship to one another extending beyond the press-sealed portion of the envelope. The lead-in wires are connected at their inner ends to a filament structure that is positioned within the bulb portion of the sealed envelope or capsule. A pair of sleeves are provided each defining a lamp contact pin at one end thereof. Each of these sleeves is swaged at the other end thereof for facilitating the securing of the lead-in wires therein. A ceramic base is provided having a bottom wall with a pair of holes therein for receiving the respective sleeves with the contact pin ends thereof depending from the base bottom wall and with the swaged ends thereof defining a limiting means for enabling the positioning of the sleeves in proper relation relative to the ceramic base. A cement is disposed in the ceramic base and is cured to secure the sleeves and lead-in wires in the ceramic base. The sleeves are swaged to the lead-in wires at the same distance from the filament for both sleeves. The sleeves are swaged at a distance along the lead-in wires to provide the proper predetermined light center length of the lamp as measured from the center of the filament structure to the underside of the ceramic base bottom wall. Each sleeve is preferably also welded to its corresponding lead-in wire to enhance contact between the sleeve and lead-in wire. The swaged ends of the sleeves are positioned to contact the top side of the ceramic base bottom wall to define the limiting position of the sleeves. The holes in the ceramic base bottom wall are of a diameter to snugly receive the sleeves but are furthermore of a diameter less than the maximum width at the swaged end to thereby limit the position of each sleeve by contact of the swaged end of the sleeve against the top side of the ceramic base bottom wall.

Also in accordance with the invention, there is provided an improved method of assembly of a lamp, such as a high temperature tungsten halogen lamp. This lamp is comprised of a sealed envelope of vitreous material having a bulb portion and a press-sealed portion at one end thereof with a pair of electrically conductive lead-in wires hermetically sealed through the press-sealed portion in spaced apart relationship to one another and extending beyond the press-sealed portion with the lead-in wires connected to a filament structure positioned within the bulb portion. This method comprises the steps of providing a pair of sleeves each defining a lamp contact pin at one end thereof. The lead-in wires are inserted into the respective sleeves at an opposite end thereof. The sleeves are swaged to the lead-in wires at the opposite ends of the sleeves to secure the sleeves to respective lead-in wires. A ceramic base is provided with a bottom wall having a pair of holes therein for receiving the respective sleeves with the contact pin ends thereof depending from the base bottom wall and with the swaged ends thereof defining a limiting means for positioning of the sleeves in proper relation relative to the ceramic base. Finally, the ceramic base is cemented to secure the lead-in wires and sleeves in the ceramic base.

BEST MODE FOR CARRYING OUT THE INVENTION

For a better understanding of the present invention together with other and further objects, advantages and capabilities thereof, reference is made to the following disclosure and appended claims in connection with the above described drawings.

In accordance with the present invention there is now described in further detail herein an improved lamp construction and associated method of manufacture thereof. In the embodiment disclosed herein, the invention involves the use of swaged contact pins formed by sleeve members that are adapted to be secured to uniformly spaced outer leads of a capsule such as a tungsten halogen lamp capsule. This capsule is adapted for insertion into a ceramic base. The sleeves are adapted to be secured at a precise distance from the lamp capsule filament to in turn enable accurate determination of the light center length of the lamp. The swaged ends of the sleeves determine the depth of support of the capsule within the base.

Figure 1:
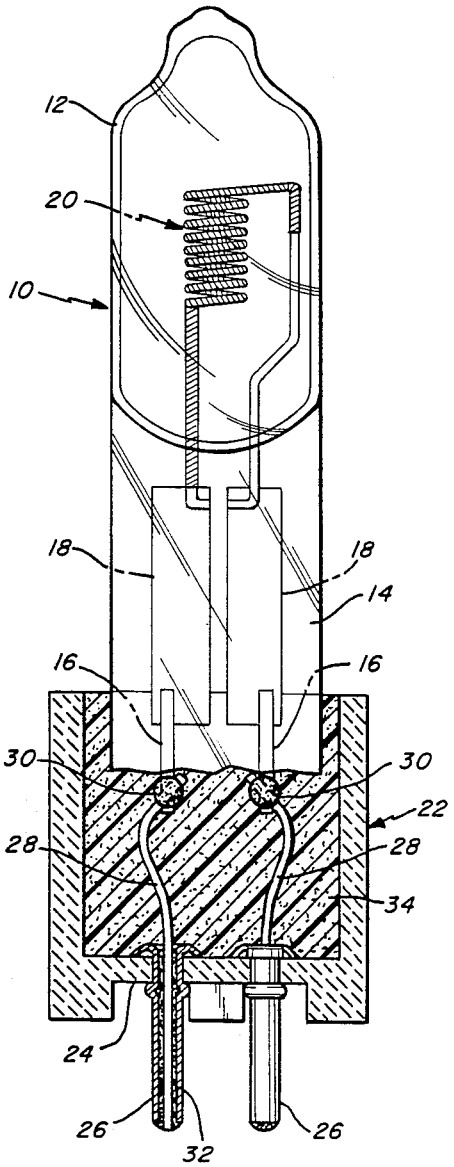
Fig. 1 PRIOR ART
FIG. 1 illustrates a prior art construction of an incandescent lamp such as a tungsten halogen lamp.

In summary, reference is now made to the prior art cross-sectional view of FIG. 1. This prior art technique involves the insertion of capsule wires into pins already secured and crimped within the lamp ceramic base. Thus, in FIG. 1 there is shown a lamp capsule 10 that may be constructed of a vitreous material and that includes a bulb portion 12 and a press-sealed portion 14 at one end thereof. There are a pair of electrically conductive molybdenum lead-in wires 16 having respectively associated therewith molybdenum foil strips 18. These electrically conductive lead-in wires 16, along with their associated foil strips 18, are hermetically sealed through the press sealed portion and are disposed in spaced apart relationship to one another. The lead-in wires 16 extend beyond the press-seal portion as illustrated in FIG. 1. The molybdenum foil strips 18 connect to a filament coil 20. The filament coil 20 is disposed in the bulb portion 12 of the lamp capsule 10.

FIG. 1 also illustrates the ceramic base 22 that has a bottom wall 24 with spaced holes therein for receiving the contact pins 26. Before the lamp capsule 10 is inserted in the base 22, a pair of lead wires 28 are welded at 30 to the lead-in wires 16. The lead wires 28 may be nichrome wires and are illustrated in FIG. 1 as extending into the hollow contact pins 26. The lead wires 28 are soldered within the contact pins 26 as illustrated at 32 in FIG. 1. The contact pins 26 may be of nichrome plated brass.

In constructing the prior art lamp of FIG. 1, the molybdenum leads 16 are sandblasted. These leads are then trimmed to the correct length. The lead wires 28 are welded (at 30) to the molybdenum leads 16 extending from the capsule. The pins 26 are staked into the bottom wall 24 of the ceramic base 22 to form a subassembly. The lead wires 28 are dipped into a solder flux and inserted into the contact pins 26 to an established depth to provide the aforementioned light center position of the lamp. The leads are soldered to the pin by dipping into lead-zinc solder (95:5) and the excess lead wire length is trimmed flush with the end of the contact pins 26. The ceramic base 22 is then filled with a cement at 34. The lamp is then inserted into an oven to cure the cement.

As indicated previously, the prior art embodiment of FIG. 1 has several disadvantages and drawbacks associated therewith. Broken welds can occur at 30. Both welding and soldering steps are required. There is a poor appearance of the finished assembly. Reworking is required due to broken lead wire welds and improper positioning during the soldering operation. There is a requirement that the contact pins be staked in the ceramic base in a secure position Now, in accordance with the present invention these drawbacks are overcome by the lamp construction as now illustrated in FIGS. 2–5.

The improved lamp construction of the present invention comprises a sealed envelope or capsule 40 that may be constructed of a vitreous material such as quartz and that includes a bulb portion 42 as well as a press-sealed portion 44 at one end thereof. There are provided a pair of electrically conductive lead-in wires which are molybdenum leads 46 having associated therewith molybdenum foil strips 48. A portion of the leads 46 and the entire molybdenum strips 48 are hermetically sealed in the press-sealed portion 44 and are disposed in spaced apart relationship to one another. The molybdenum lead-in wires 46 extend beyond the press-sealed portion 44. A filament coil 50 couples between the foil strips 48 as illustrated in the drawings. The filament coil is positioned within the bulb portion 42 of the capsule 40.

Figure 3:
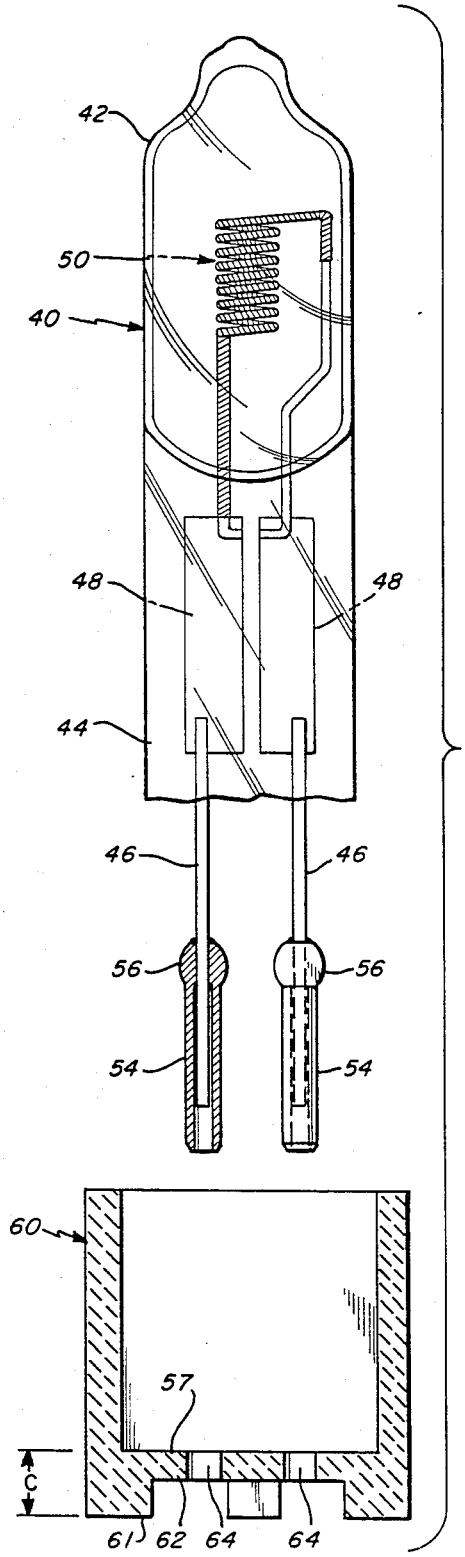
FIG. 3 is a front elevation view of the lamp construction of the invention in a subsequent step of assembly.
Figure 4:
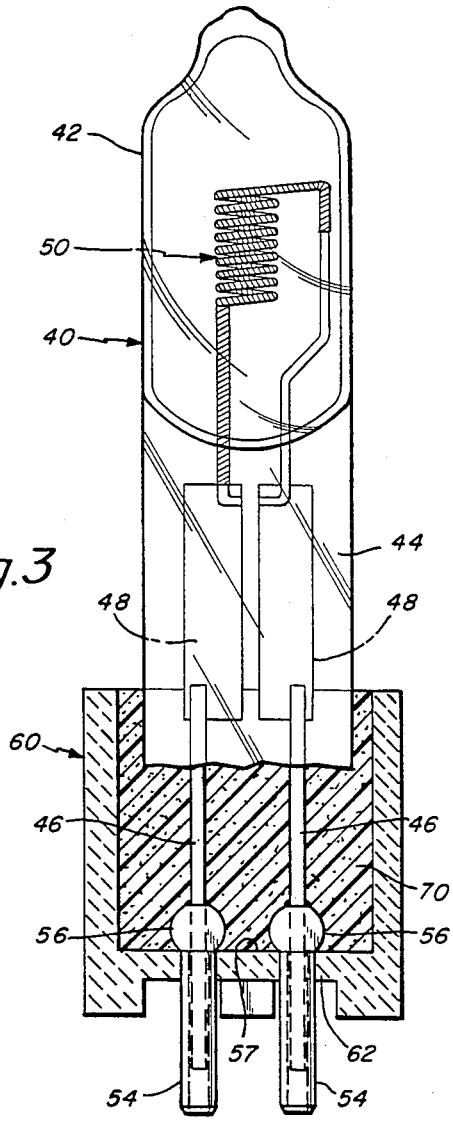
FIG. 4 is a front elevation view partially in cross-section illustrating the final assembled lamp construction in accordance with the present invention.

FIGS. 3 and 4 illustrate the ceramic base 60 in which the capsule 40 is disposed. The ceramic base 60 has a bottom wall 62 with spaced holes 64 disposed therein. As illustrated in FIG. 3, the ceramic base 60 is considered as having its bottom wall of maximum thickness as represented by the dimension C.

The drawings also illustrate, and in particular FIGS. 3 and 4, the sleeves 54 that are swaged at 56 (to form a rounded configuration) to the lead-in wires 46. These sleeves 54 are disposed within the holes 64 in the base walls 62 of the ceramic base 60. The sleeves 54 at their bottom ends form cylindrically-shaped, straight sided contact pins for the lamp. At the rounded swage 56 of the sleeves 54, as illustrated, for example, in FIG. 4, there is contact with the top side surface 57 of the bottom wall 62. This contact of the swage 56 with the top side wall 57 provides a limiting means for positioning the capsule in the ceramic base 60, as will be described in further detail hereinafter.

In accordance with the present invention, the lamp capsule 40 is constructed in a manner so that the conductive lead-in wires 46 have the same spacing therebetween as the desired spacing of the pins 54 in the lamp base 60. This spacing may be, in one example, about 0.210 inch. After the capsule has been formed and aged, and, depending on the application and the lamp type, a solder glass may be applied to the area where the lead-in wires 46 extend from the capsule.

Figure 2:
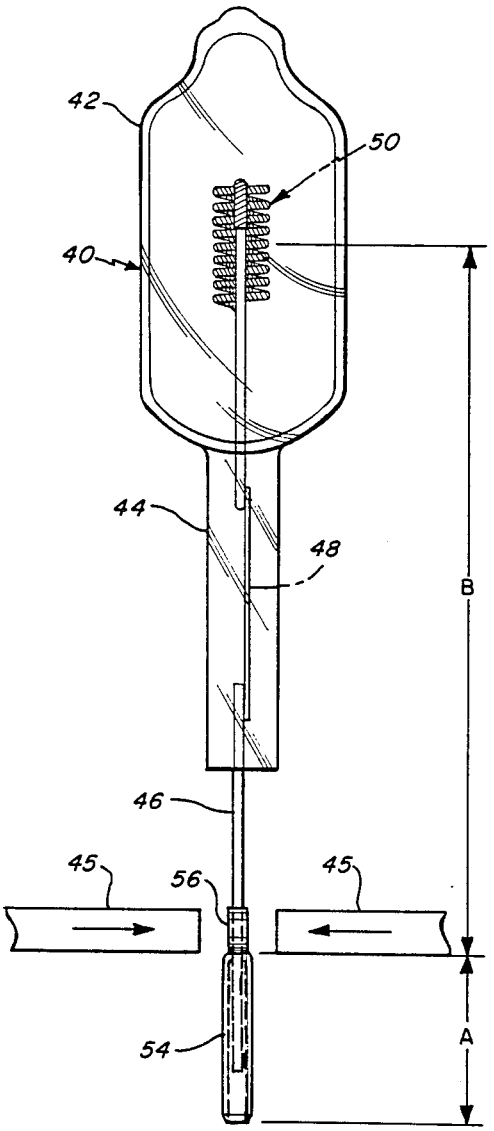
FIG. 2 is a side elevation view of an intermediate step in the construction of a lamp in accordance with the present invention.

Each sleeve 54 is inserted onto the respective ends of the lead-in wires 46 to a position as illustrated, for example, in FIG. 2. When in the proper position the sleeves 54 are then crimped or swaged as illustrated at 56 so as to secure the sleeves to their respective lead-in wires 46. This crimping process is carried out with the use of a mechanism not illustrated herein that is attached to a comparator. A pair of sleeves 54 are inserted into holes in the aforementioned mechanism and this mechanism is precisely located with respect to the bottom of the crimping tool. In this regard, refer to FIG. 2 and the illustrated crimping tool 45 that is providing the swaging of the sleeve to the lead-in wire. In connection with the use of this support mechanism for the sleeves, initially the capsule lead-in wires 46 are inserted into the sleeves 56 and adjusted in relative position so that the coil 50 position is set on the comparator. The position of the coil center screen of the comparator is set precisely with respect to the bottom of the crimping tool 45. Again, in this regard, refer to FIG. 2 for an illustration of an initial step in the method of manufacture showing the crimping tool having formed the rounded swage in the sleeve at 56.

Figure 5:
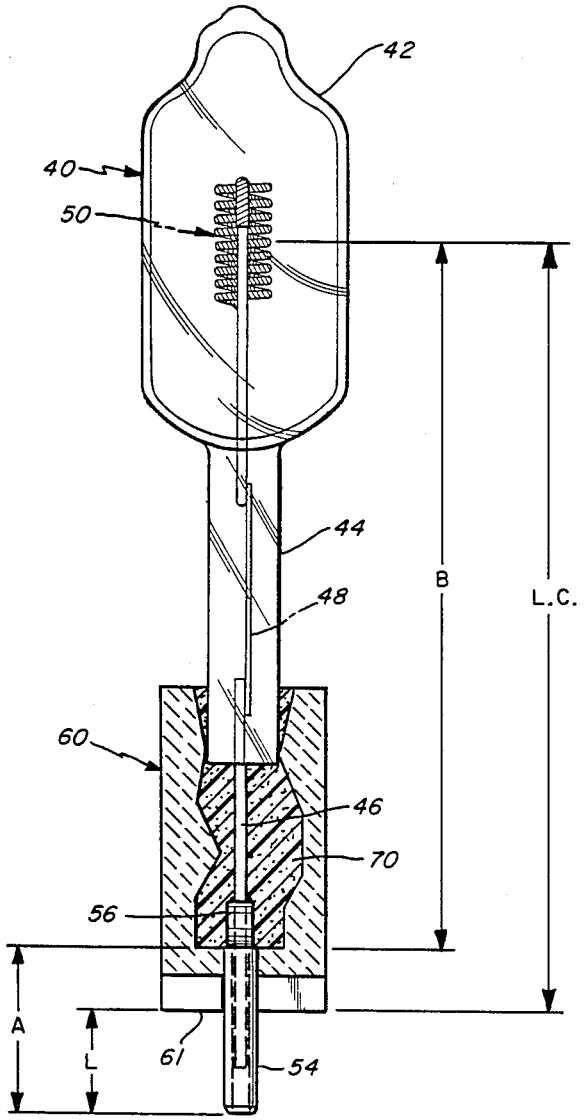
FIG. 5 is a side elevation view, partially cut away, of the lamp of FIG. 4.

Now, reference is made to FIGS. 2, 3 and 5 in connection with certain dimensional considerations regarding the manufacture of the lamp in accordance with the invention. In this connection, and with reference to FIG. 5, the light center length (LC) is identified as the distance from the center of the coil 50 to the very bottom surface 61 of the ceramic base 60. In FIGS. 2 and 5 the dimension A is representative of the summation of the desired pin length (dimension L in FIG. 5) and the base thickness (dimension C in FIG. 3). Once the light center length is selected, then the positioning of the crimping tool 45 can be set. In this regard, refer to dimension B in FIG. 2. This dimension is determined by subtracting the base thickness, dimension C, from the light center length, dimension LC, in FIG. 5. Thus, by positioning the sleeves 54 in the holes 64 in the ceramic base 60 so that the rounded swages 56 each contact the flat surface 57, the lamp capsule 40 is in the proper position in the base 60 so as to provide the proper light center length LC as illustrated in FIG. 5.

After the sleeves 54 have been swaged to the lead-in wires 46 extending from the capsule, and prior to insertion of the sub-assembly into the ceramic base 60, a weld is preferably made at the swage area to improve the contact between each of the sleeves 54 and the capsule lead-in wires 46. As a next step, the capsule/sleeve assembly is inserted into the holes 64 in the ceramic base 60 with the cylindrical ends of the sleeves extending through the base to form the smooth surfaced contact pins external of the base. These pins are adapted for being inserted into a lamp socket. Once, in this assembly step, that swage 56 has been properly seated against the flat surface 57, the ceramic base 60 is then filled with cement as illustrated at 70 in FIGS. 4 and 5, and the assembled lamp is then cured to secure the parts into one integral assembly.

Because of the inaccuracy of measuring seal temperature, it has not been proven at this time that the method of assembly of this invention reduces seal temperature and therefore reduces the probability of seal failure in high temperature applications. However, life tests of lamps made with this assembly method indicate that seal life is better with the assembly method of the present invention in comparison to a prior method of assembly such as the one illustrated in the prior art view of FIG. 1 herein. The following table shows a comparison, for two different lamp types comparing lamps constructed in accordance with the prior art assembly method as well as the assembly method of the present invention in connection with both average lamp life and percent of seal failure.

TABLE

| | LAMP TYPE | | | |
|---|---|---|---|---|
| | EYB | | GCA | |
| | OLD N = 10 | NEW N = 10 | OLD N = 10 | NEW N = 6 |
| AVG. LIFE | 60 | 75 | 140 | 205 |
| % SEAL FAILURE | 40 | 0 | 60 | 0 |

It is noted in accordance with the improved method of manufacture of the present invention that the overall method of assembly is substantially simplified in comparison to techniques such as defined for the prior art embodiment of FIG. 1. The number of component parts and the number of steps in the assembly are fewer in comparison to these prior art procedures. Also, in connection with the method of manufacture of the present invention, the associated cost is substantially lower. Remarkably, the average savings per lamp represents slightly more than fifty percent of the cost of the prior art construction.

While there have been shown and described what are at present considered the preferred embodiments of the invention, it will be obvious to those skilled in the art that various changes and modifications may be made therein without departing from the scope of the invention as defined by the appended claims.

What is claimed is:

1. A method of making a lamp comprised of a sealed envelope of vitreous material having a bulb portion and a press-sealed portion at one end thereof with a pair of electrically conductive lead-in wires hermetically sealed through said press-sealed portion in spaced-apart relation ship and extending beyond said press-sealed portion with said lead-in wires connected to a filament structure positioned within said bulb portion, said method comprising the steps of:

providing a pair of sleeves each defining a lamp contact pin at one end thereof;

inserting each of said lead-in wires into a respective one of said sleeves at an opposite end thereof from said contact pin;

swaging said sleeves to said lead-in wires at said opposite ends of said sleeves to secure said sleeves to each of said respective lead-in wires;

providing a ceramic base with a bottom wall having a pair of holes therein for receiving each of said respective sleeves with said contact pin ends thereof depending from said base bottom wall and with said swaged ends thereof defining a limiting means for positioning said sleeves in proper relation relative to said ceramic base; and cementing said lead-in wires and sleeves within said ceramic base.

2. A method as set forth in claim 1 wherein said sleeves are swaged to said lead-in wires at the same distance from the filament for both sleeves.

3. A method as set forth in claim 2 wherein said sleeves are swaged at a distance along the lead-in wires to provide the proper predetermined light center length of the lamp as measured from the center of the filament structure to the underside of the bottom wall of said ceramic base.

4. A method as set forth in claim 3 further including the steps of welding the sleeve at said swaged location to enhance contact between said sleeve and respective lead-in wire.

5. A method as set forth in claim 4 further including adding a quantity of cement within said base and thereafter curing said cement to form an assembled lamp and base assembly.

6. A method as set forth in claim 1 wherein said swaged ends of said sleeves are positioned to contact the top side of said ceramic base bottom wall to define the limiting position of said sleeves.

7. A lamp comprising:

a sealed envelope of vitreous material having a bulb portion and a press-sealed portion at one end thereof;

a pair of electrically conductive lead-in wires hermetically sealed through said press-sealed portion in spaced-apart relationship therein and extending beyond said press-sealed portion, said lead-in wires being connected at their inner ends to a filament structure positioned within said bulb portion of said sealed envelope;

a pair of sleeves each defining a lamp contact pin at one end thereof and positioned around the outer ends of said lead-in wires, and swaged thereto to secure each of said sleeves to a respective one of said lead-in wires;

a ceramic base having a bottom wall with a pair of holes therein for receiving each of said sleeves with the contact pin ends thereof depending from said base bottom wall and with the swaged ends thereof defining a limiting means for positioning of the sleeves in proper relation relative to said ceramic base; and a cement cured to secure the sleeves and the lead-in wires within said ceramic base.

8. A lamp as set forth in claim 7 wherein said sleeves are swaged to said lead-in wires at the same distance from the filament for both of said sleeves.

9. A lamp as set forth in claim 8 wherein said sleeves are swaged at a distance along said lead-in wires to provide the proper predetermined light center length of the lamp as measured form the center of the filament structure to the underside of the ceramic base bottom wall.

10. A lamp as set forth in claim 7 wherein each sleeve is welded to its corresponding lead-in wire to enhance contact between the sleeve and lead-in wire.

11. A lamp as set forth in claim 7 wherein the swaged ends of the sleeves are positioned to contact the top side of the ceramic base bottom wall to define the limiting position of the sleeves.

12. A lamp as set forth in claim 7 wherein the holes in the ceramic base bottom wall are of a diameter to snugly receive the sleeves but said diameter is less than the maximum width at the swaged end to thereby limit the position of each sleeve by contact of the swaged end of the sleeve against the top side of the ceramic base bottom wall.

13. A method of making a lamp comprised of a sealed envelope of vitreous material having a bulb portion and a press-sealed portion at one end thereof with a pair of electrically conductive lead-in wires hermetically sealed through said press-sealed portion in spaced-apart relationship and extending beyond said press-sealed portion with said lead-in wires connected to a filament structure positioned within said bulb portion, said method comprising the steps of:

providing a pair of sleeves each defining a lamp contact pin at one end thereof;

inserting each of said lead-in wires into a respective one of said sleeves at an opposite end thereof from said contact pin;

conductively fixing each of said lead-in wires to each of said respective sleeves to both position said filament structure with respect to said sleeve and form limiting means on each of said sleeves relative to said sleeve ends;

subsequently providing a ceramic base with a bottom wall having a pair of holes therein for receiving each of said respective sleeves with said contact pin ends thereof depending from said base bottom wall and with said limiting means for positioning said sleeves in proper relation relative to said ceramic base and as a result positioning said filament relative to said base; and cementing said lead-in wires and sleeves within said ceramic base.

14. The method in claim 13, wherein said step of conductively fixing includes swaging said sleeve to said lead-in wire.

15. A lamp comprising:

a sealed envelope of vitreous material having a bulb portion and a press-sealed portion at one end thereof;

a pair of electrically conductive lead-in wires hermetically sealed through said press-sealed portion in spaced-apart relationship therein and extending beyond said press-sealed portion, said lead-in wires being connected at their inner ends to a filament structure positioned within said bulb portion of said sealed envelope;

a pair of sleeves each defining a lamp contact pin at one end thereof and each conductively fixed by swaging to a respective one of said lead-in wires to position said sleeve with respect to the filament; each of the sleeves having limiting means formed along the respective sleeve;

a ceramic base having a bottom wall with a pair of holes therein for receiving each of said sleeves with said contact pin ends thereof depending from said base bottom wall and with said limiting means positioning said sleeves with respect to said ceramic base; and as a result positioning said filament with respect to said base; and a cement cured to secure the sleeves and the lead-in wires within said ceramic base.

16. The lamp in claim 15, wherein the limiting means comprises a swaging made along the length of said sleeve.

17. The lamp in claim 15, wherein said conductive fixing of said sleeves to said lead-in wires includes swaging said sleeves to said lead-in wires.

* * * * *